US006053490A

United States Patent [19]

Berchtold

[11] Patent Number: 6,053,490

[45] Date of Patent: Apr. 25, 2000

[54] CLAMPING DEVICE ESPECIALLY A MACHINE VICE

[75] Inventor: Heinrich Berchtold, Nänikon/Uster, Switzerland

[73] Assignee: Gressel AG, Aadorf, Switzerland

[21] Appl. No.: 09/146,883

[22] Filed: Sep. 3, 1998

[30] Foreign Application Priority Data

Sep. 8, 1997 [DE] Germany ..... 297 16 103 U

[51] Int. Cl.[7] ..... B25B 1/20

[52] U.S. Cl. ..... 269/43; 269/154; 269/244

[58] Field of Search ..... 269/43, 136, 138, 269/153, 154, 242, 906, 244, 152

[56] References Cited

U.S. PATENT DOCUMENTS

| | | | |
|---|---|---|---|
| 4,934,674 | 6/1990 | Bernstein . | |
| 5,098,073 | 3/1992 | Lenz | 269/43 |
| 5,374,040 | 12/1994 | Lin | 269/43 |
| 5,505,437 | 4/1996 | Durfee | 269/43 |
| 5,702,096 | 12/1997 | Buck | 269/43 |
| 5,893,551 | 4/1999 | Cousins et al. | 269/43 |

OTHER PUBLICATIONS

Company Brochure of HILMA–ROEMHELD GMBH, "Technische Daten/Zubehoer, Doppelspannsystem DS 125" [Technical data/accessories double clamping system DS 125], 4.3660, pp. 1–4 Issue 3/96.

*Primary Examiner*—Robert C. Watson

*Attorney, Agent, or Firm*—Flynn, Thiel, Boutell & Tanis P.C.

[57] ABSTRACT

The clamping device includes a body with two slides which can slide therein. The slides each carry a jaw that can be shifted opposite to the other jaw by an axially movable screw spindle. A central jaw can be fixed in the central region of the body. An abutment part is arranged at an operating end of the body, in the lower region of the slide and of the body facing away from the jaw. The abutment part has a lug which can shift to a limited extent in an end recess of the base part of the body. A spring arrangement is supported at one end on the lug and at the other end in a pocket of the base part. The abutment part includes a finger which engages in a longitudinal groove provided at the underside of the slide and carries a clamping element at its free end facing towards the central jaw, with which device the finger can be jammed in the longitudinal groove.

7 Claims, 5 Drawing Sheets

CLAMPING DEVICE ESPECIALLY A MACHINE VICE

FIELD OF THE INVENTION

This invention relates to a clamping device, especially a machine vice, with a body, two slides movable therein, which each carry a jaw on their upper side and which can be shifted in opposite directions by means of an axially movable screw spindle, a central jaw which can be fixed in the central region of the body, an abutment part arranged in the region of the operating end of the body and movable relative thereto, a clamping device associated therewith, a spring arrangement supported on the abutment part and acting in the direction of displacement of the slides, which arrangement exerts a force on one of the slides in the opening direction thereof in the clamping state of the clamping device, and a retaining screw which extends through the abutment part.

BACKGROUND OF THE INVENTION

In one such known clamping device (cf. company brochure of the company HILMA-RÖMHELD GMBH, D-57260 Hilchenbach (Germany), "Technische Daten/Zubehör, Doppelspannsystem DS 125" [Technical data/accessories double clamping system DS 125], 4.3660, page 1, issue 3/96) the abutment part is arranged to slide in the body by the operating end of the one slide. A clamping screw is provided in the abutment part, running perpendicular to the base part of the body, with which the abutment part can be clamped fast relative to the body, when the so-called "THIRD HAND function" described in further detail below is desired. Two helical springs are provided as the spring arrangement, and a each supported at one end on the outer side of the abutment part facing away from the slide and at the other end on the head of a retaining screw, which passes through the abutment part and is screwed into the slide. The abutment part is normally pressed on to the slide by this spring arrangement and is displaced together with the slide. Two workpieces can be clamped at the same time by actuation of a single screw spindle in the known clamping device and they can even have different dimensions. One of the workpieces is clamped between the jaw of the first slide at the operating end and the central jaw, the other workpiece between the jaw of the second slide and the central jaw. Before the clamping it is mostly necessary to align each of the workpieces accurately relative to the body or the jaws. With many workpieces it is necessary to hold the workpiece in the aligned position long enough, until the jaws are pressed with sufficient force on to the workpiece. If however there are two workpieces which have to be held in the aligned position, two hands are needed for this and there is then no hand free for actuating the screw spindle. This problem also always occurs when the body is arranged vertically on a machine table. The so-called "THIRD HAND function" is provided in order that one can firstly align one of the workpieces in such a clamping device with only one screw spindle and then clamp it enough for its to be retained in the aligned position between the jaws. In this case, by first turning the screw spindle the spacing required for the second workpiece between the second jaw and the central jaw is created and this workpiece is then placed between these two jaws. By drawing the slide and jaw unit on the operating end towards the operating end, the second jaw is brought into abutment with the second workpiece and the latter with the central jaw, without play. While maintaining this contact free from play the distance between the operating end first jaw and the central jaw is so adjusted by further rotation of the screw spindle that the first workpiece can just be fitted between these two jaws. The abutment part is clamped fast relative to the body in this position by actuating the clamping screw. The screw spindle is now actuated, whereby the second workpiece is gripped between the second jaw and the central jaw and is held in the aligned position, but is not clamped fast. This gripping replaces the third hand and is therefore called the THIRD HAND function. The gripping of the second workpiece has been made possible in that the first slide is initially held immovable relative to the body by the clamped abutment part and the spring arrangement. After the second workpiece has been gripped in the described manner, one hand is free again and can be used to fit the first workpiece between the jaw of the first slide and the central jaw. On further rotation of the screw spindle the first slide is now displaced against the force of the spring arrangement towards the first workpiece and the first workpiece is gripped between the jaw of the first slide and the central jaw. On further rotation of the screw spindle the two workpieces are finally clamped. When the clamping device is to be released again after completion of machining of the workpieces, the jaws of the first workpiece come free first, while the second workpiece remains gripped in the described manner with the THIRD HAND function turned on. This has the advantage with a vertically standing body that the second workpiece does not fall out of the clamping device when the first workpiece is taken out by one hand and the screw spindle is actuated with the other hand.

Since the abutment part in the known clamping device is arranged alongside the first slide, swarf can fall during machining between the first slide and the abutment part. If this is not removed carefully before unclamping the THIRD HAND function no longer works properly. Moreover either a greater total length of construction of the clamping device or a smaller opening stroke of the jaws results from the arrangement of the abutment part beside the first slide.

In a similar known clamping device (U.S. Pat. No. 5,098,073) the abutment part is arranged outside on the face of the operating end of the body. It surrounds a sleeve concentric with the spindle and axially immovable relative thereto and can be clamped fast thereon in different axial positions. The abutment part also engages slightly in a recess provided in the face of the operating end. The abutment part comprises a lug underneath the spindle, which also engages in the end recess. An annular shoulder is provided in a bore of the lug and a spring arrangement engages on each of the two sides thereof A retaining screw, on which one of the spring arrangements bears, is passed through both spring arrangements and screwed into the base part of the body. The spindle is held axially immovable relative to the body by these two spring arrangements, until one of the movable jaws bears on the first workpiece. This clamping device also has the disadvantage that the abutment part and the sleeve also project for their full length beyond the end face of the operating end and thus substantially increase the overall length of construction of the clamping device. Swarf can also fall between the abutment part and the recess and affect the function.

Another known clamping device (U.S. Pat. No. 4,934,674) has the same disadvantage, being very similar to the previously described clamping device. In this clamping device also the abutment part surrounding the spindle is disposed outside the end of the body, so that the overall length of construction of the clamping device is increased.

SUMMARY OF THE INVENTION

The invention is therefore based on the object of providing a clamping device, especially a machine vice, of the kind initially referred to, which is less sensitive to contamination and whose structural length or opening width is not adversely affected by the abutment part.

This is achieved according to the invention in that the abutment part is disposed in the lower region of the slide and of the body facing away from the jaw, in that the abutment part has a lug which can slide to a limited extent in an end recess of the base part of the body, in that the spring arrangement is supported at one end on the lug and at the other end in a pocket of the base part, in that the abutment part further comprises a finger which engages in a longitudinal groove provided at the underside of the slide and carries the clamping device at its free end facing the central jaw, with which device the finger can be jammed in the longitudinal groove.

The invention therefore proceeds from the idea of arranging the abutment part essentially underneath the slide. The abutment part is hereby covered by the slide during the machining. In particular there is no gap open to the machining side between the slide and the abutment part, so that accordingly no swarf or other dirt can settle. Thus a satisfactory THIRD HAND function is always guaranteed. The result of the special arrangement of the abutment part underneath the slide and its design, as well as the placement of the spring arrangement in a pocket of the base part is that the abutment part and all of the components needed for the THIRD HAND function do not in any way affect the constructional length of the clamping device adversely.

Advantageous arrangements of the invention are characterized in the dependent claims.

BRIEF DESCRIPTION OF THE DRAWINGS

The invention will be explained in more detail below with reference to an embodiment shown in the drawings, in which.

DETAILED DESCRIPTION

Figure 3:
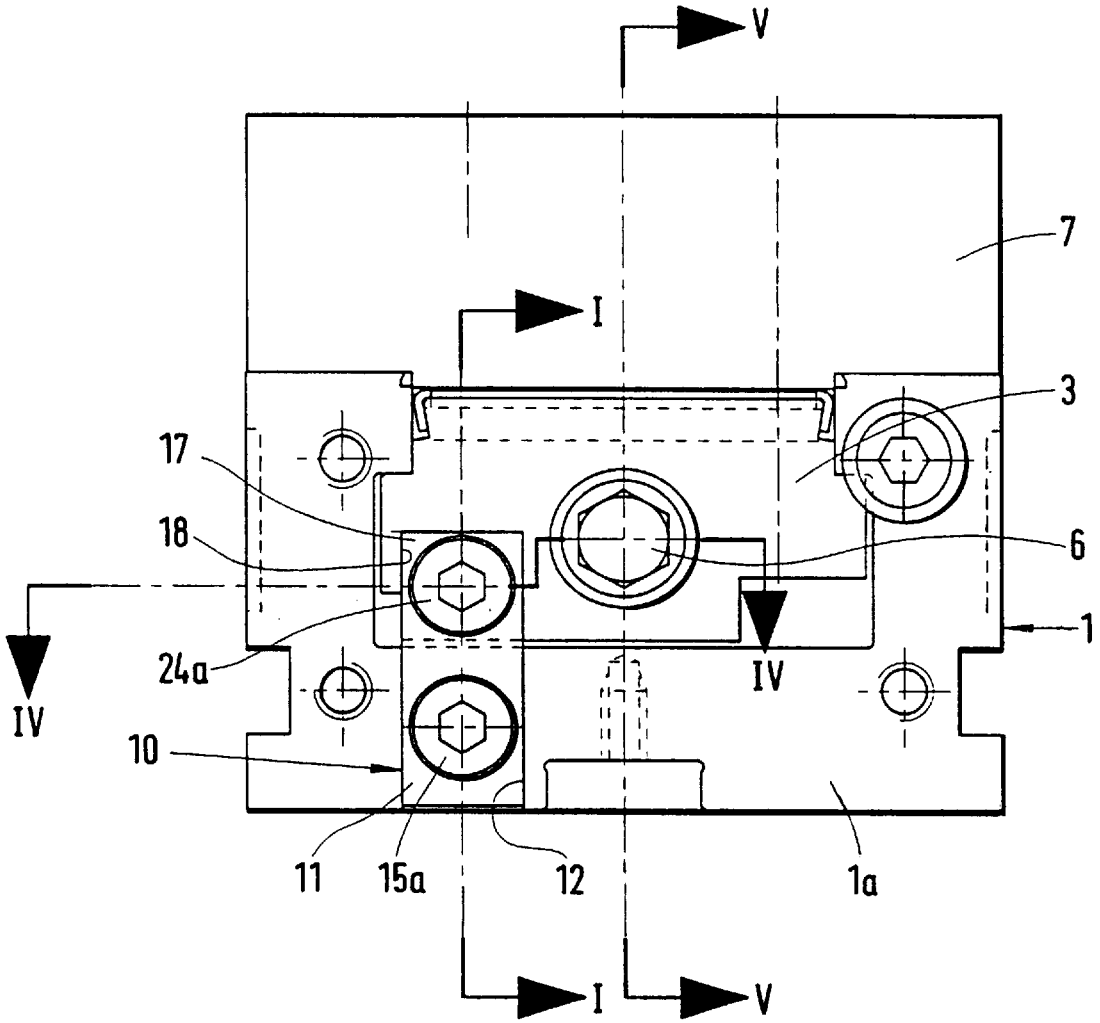
FIG. 3 is an end view in the direction III of FIG. 1.
Figure 4:
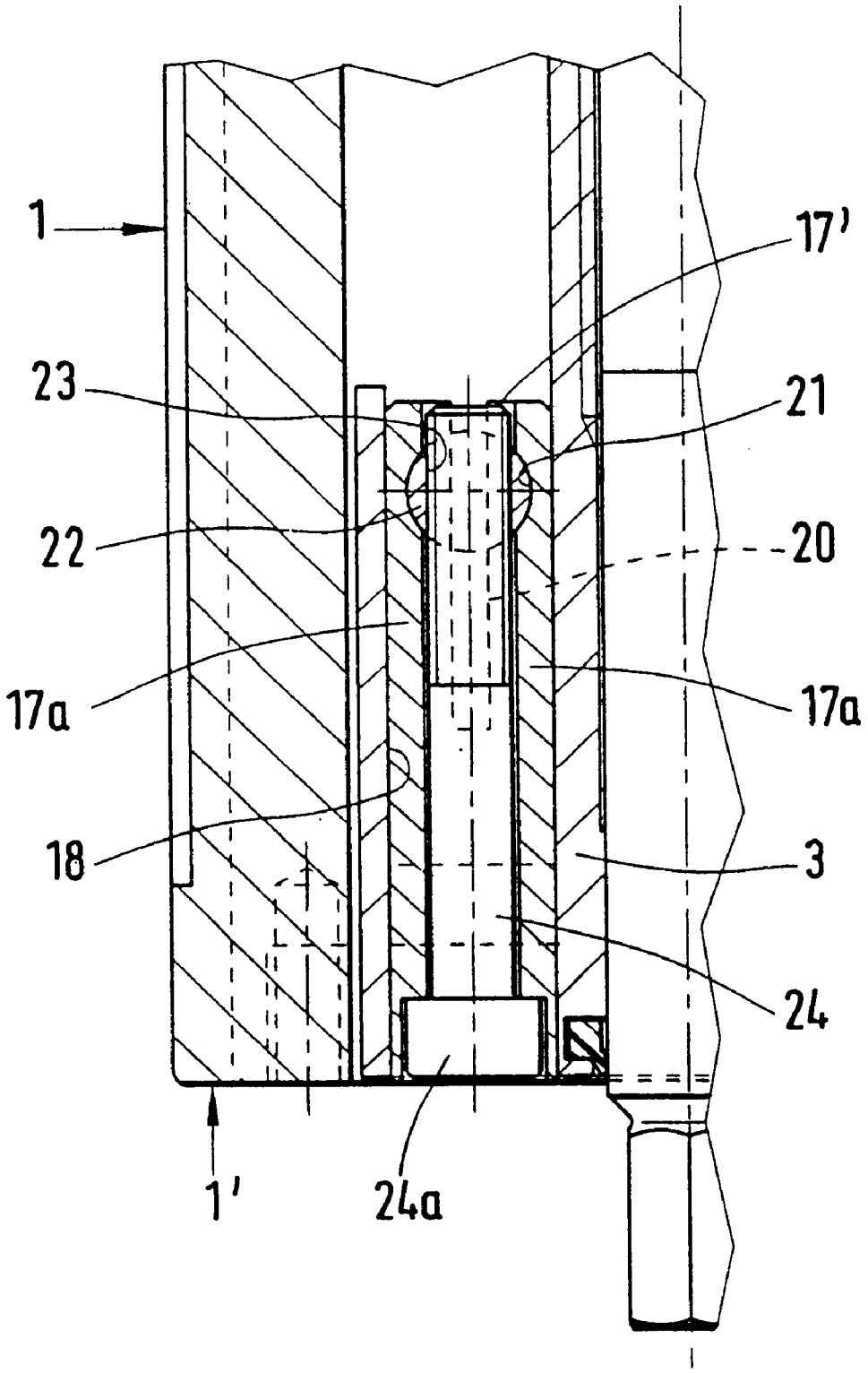
FIG. 4 is a partial longitudinal section on the line IV—IV of FIG. 3.
Figure 5:
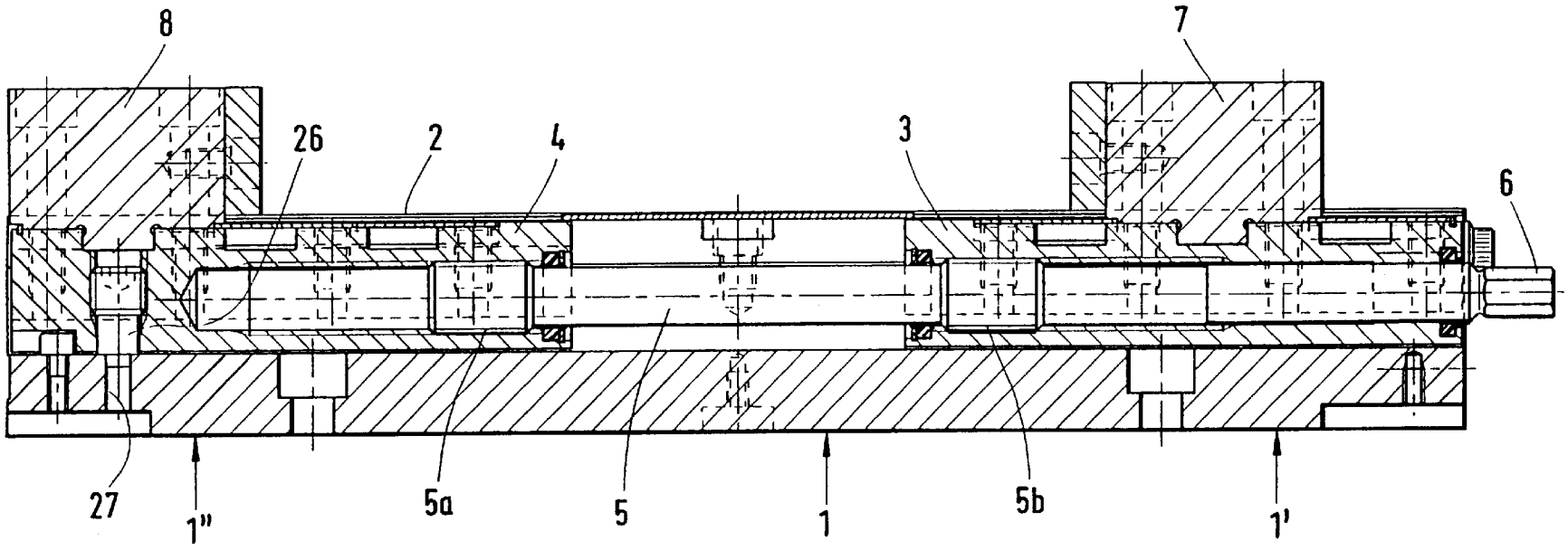
FIG. 5 is a further longitudinal section on the line V—V of FIG. 3.

The clamping device according to the invention is a so-called double vice, with which two workpieces can be clamped simultaneously, or a large workpiece can be clamped with the central jaw removed. The body 1 has a substantially U-shaped cross-section, as can be seen in FIG. 3. The upper ends of the two U arms form bearing surfaces 2 for the workpieces. Two slides 3, 4 are guided in the body to move in the longitudinal direction thereof. The drive of these slides 3, 4 is effected through a screw spindle 5, whose threads 5*a*, 5*b* have opposite hands. The threads 5*a*, 5*b* engage in corresponding female threads of the slides 3, 4. The screw spindle 5 has a hexagon 6 or the like at one of its ends for fitting a handle or a crank, not shown. The end of the clamping device lying in the region of the hexagon 6 is here called the operating end.

Each of the two slides 3, 4 carries a jaw 7, 8 on its upper side, which can be shifted in position in the slide longitudinal direction and also interchanged. A central jaw 9 can be fixed in the central region of the body 1.

An abutment part 10 is provided at the operating end 1' of the body 1. This abutment part 10 is arranged essentially in the lower region of the slide 3 and of the base body 1 facing away from the jaw 7. The abutment part 10 has a downwardly projection lug 11, which can move to a limited extent in an end recess 12 of the base part 1*a* of the body, in the longitudinal direction thereof. The base part 1*a* here designates the web part connecting the two U arms of the body 1. A spring arrangement 13, which can consist for example of the helical spring shown in the drawings or if desired of a plurality of Belleville springs, is supported at one end on the lug 11 and at the other end in a pocket 14 provided in the base part 1*a*. A retaining screw 15 is provided coaxially within this spring arrangement 13 and is screwed into a threaded bore 16 disposed at the bottom of the pocket 14 and supports the lug 11 subjected to the action of the spring arrangement 13 by its head 15*a*. The retaining screw 15 passes through the lug 11.

The abutment part 10 further comprises a finger 17, which engages in a downwardly open longitudinal groove 18 provided in the underside of the slide 3. The finger 17 has a clamping device or element 19 to be described in more detail below at its free end 17' facing towards the central jaw 9, with which the finger 17 can be clamped fast relative to the longitudinal groove 18.

Figure 1:
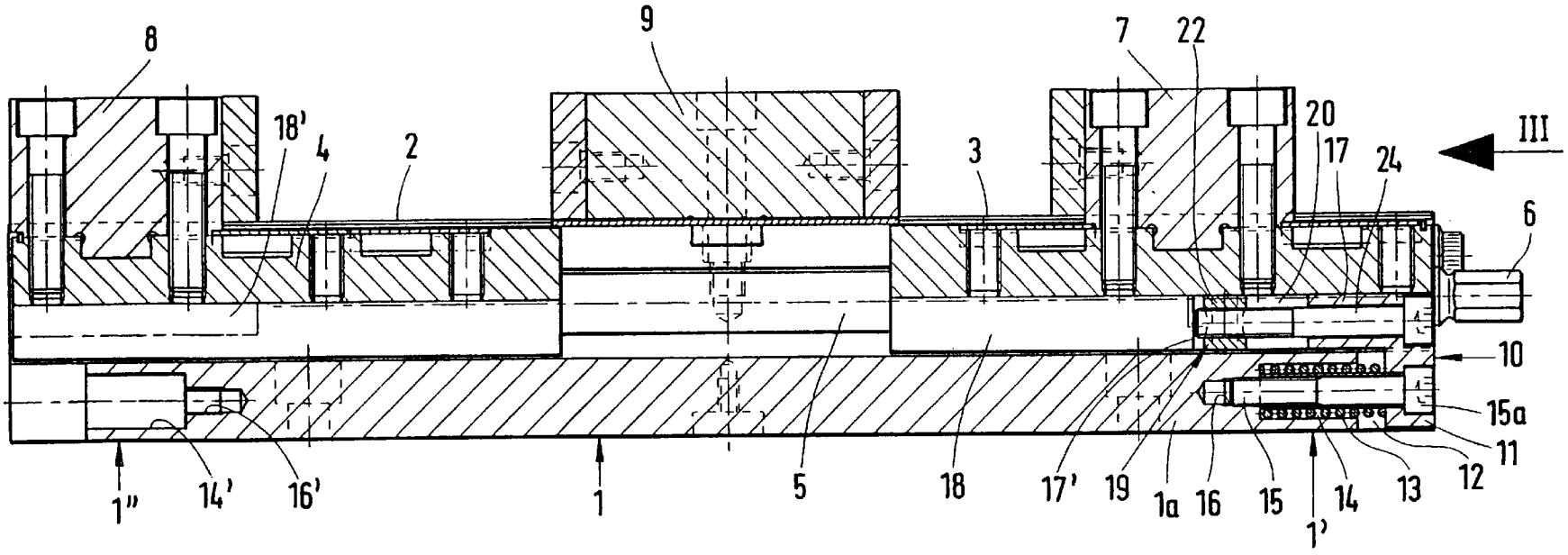
FIG. 1 is a longitudinal section of the clamping device according to the line I—I of FIG. 3.

In order to form the clamping device or element 19 the finger 17 is divided into two finger sections 17*a* by a slot 20 opening at its free end 17'. The slot 20 runs perpendicular to the base of the groove 18 and extends over a substantial part of the finger length, preferably around half thereof. In the vicinity of the free end 17' of the finger 17 there is provided a transverse bore 21, whose axis is likewise perpendicular to the groove bottom and which extends half into each finger section 17*a*. A transverse pin 22 is arranged in the transverse bore 21 and has a threaded bore 23 running transverse to its axis. A clamping screw 24 extending in the longitudinal direction of the finger 17 engages in this threaded bore 23 and its head 24*a* bears on a shoulder of the abutment part 10 in the installed position of the abutment part 10 shown in FIGS. 1 and 3.

When the clamping device is arranged flat on a work table of a machine tool or the like and workpieces do not have to be held manually during clamping, two workpieces can simply be placed in between the jaws 7, 8, 9 one after the other and the two slides 3, 4 be moved towards the central jaw 9 by turning the spindle 5, whereby both workpieces are simultaneously clamped by turning one screw spindle.

When however the workpieces first have to aligned accurately relative to the jaws 7, 8, 9 or the body 1 and each of the workpieces has to be held by hand, which is the case in particular with vertical arrangement of the body 1, the THIRD HAND function is needed, as fully set out in the introduction. After the jaws 8, 9 have been brought into contact with the workpiece inserted therebetween, without play, the slide 3 is brought to a distance from the central jaw 9, by turning the screw spindle 5, which is somewhat greater than the dimension to be clamped of the first workpiece to be placed between the jaws 7, 9. When this distance has been attained, the clamping screw 24 is turned, so that the transverse pin 22 is pulled towards the screw head 24*a*. The transverse pin 22 thus moves out of the transverse bore 21 somewhat and spreads out the finger sections 17*a* formed by the slot 20, so that they come into jamming engagement with the sidewalls of the longitudinal groove 18. The first slide 3 is thereby connected firmly to the abutment part 10, which is held by the spring arrangement 13 in the position shown in FIG. 1. After the clamping device 19 has been actuated in this manner, the spindle 5 is so turned that the slide 4 is pulled towards the central jaw 9. The first slide 3 does not move, since it is retained by the abutment part 10. On further turning of the spindle, the jaws 8, 9 are clamped with increasing force on to the second workpiece. The clamping force is dependent on the force of the spring arrangement 13. If the spring force of the spring arrangement 13 were to be overcome by further turning of the spindle, the first slide 3 with its jaw 7 would approach the central jaw 9 and then the first workpiece could no longer be inserted between the jaws 7, 9. For this reason the rotation of the spindle 5 is terminated straightway when the second workpiece is gripped strongly enough between the jaws 8, 9 not to move out of its aligned position. After the first workpiece has been inserted between the two jaws 7, 9 the spindle 5 can be turned further in the tightening direction, until the two jaws 7, 9 are also pressed against the workpiece. The force of the spring arrangement 13 has to be overcome for this. On further rotation of the screw spindle S in the tightening direction all three jaws 7, 8, 9 are pressed hard against the two corresponding workpieces and the clamping operation is thus complete. The release and removal of the workpieces is effected in the reverse manner. In a series run with workpieces of the same dimensions to be clamped one after the other, the clamping screw 24 obviously remains tightened up after the release of the jaws, since the first jaw 7 is than already adjusted to the size of the first workpiece to be clamped.

Figure 2:
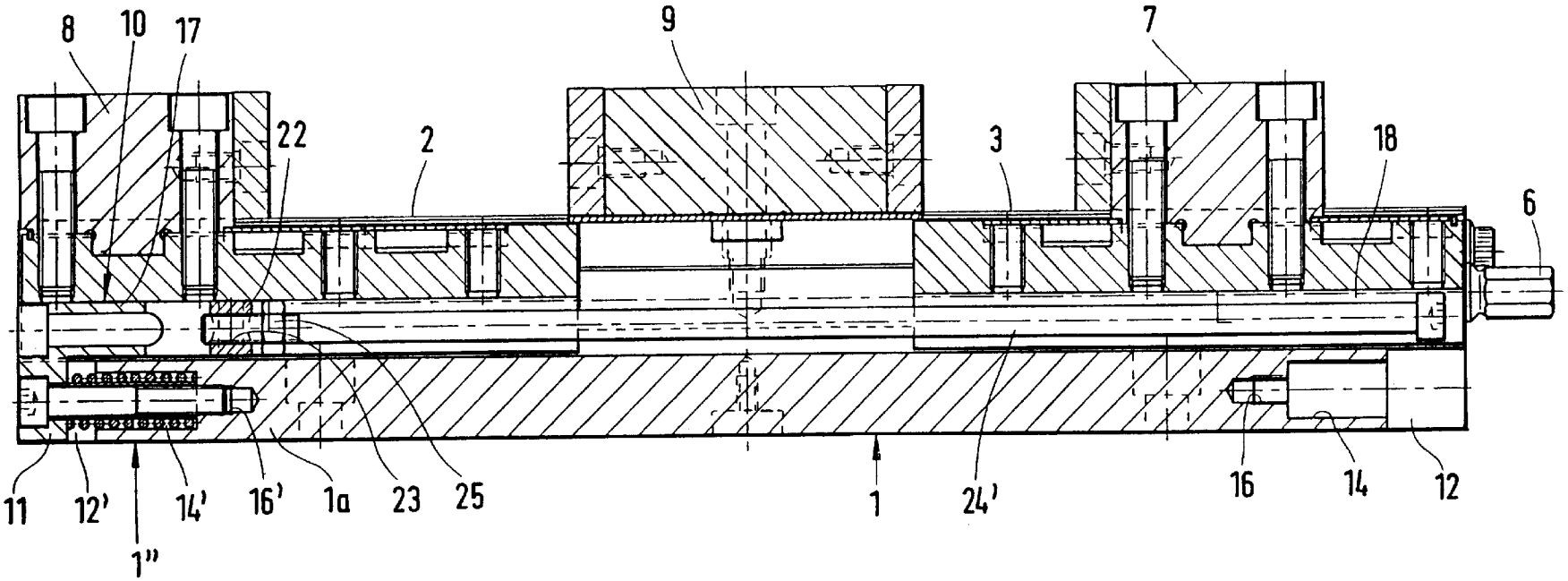
FIG. 2 is similar longitudinal section with an alternative arrangement of the abutment part.

In the described arrangement of the abutment part 10 at the operating end of the vice the second workpiece is always clamped first between the jaws 8, 9. Problems could then arise if with a vertical arrangement of the body 1 the second workpiece is heavy, so that the force of the spring arrangement 13 is insufficient to grip the second workpiece while the first workpiece is still not introduced and clamped between the jaws 7, 9. In such cases the abutment part 10, which is relative small, and above all does not require any additional space in the longitudinal direction of the clamping device, is mounted at the end 1" opposite the operating end 1' of the body 1. To this end, the base part 1*a* of the body 1 has a second recess 12' at the opposite end 1" and a second pocket 14' as well as a second threaded bore 16'. Moreover the second slide 4 is provided with a longitudinal groove 18', which lies in the extension of the longitudinal groove 18 of the first slide 3. By releasing the retaining screw 15 the abutment part 10 and the spring arrangement 13 can be removed from the operating end 1' and be mounted at the opposite end 1" of the body 1. The retaining screw 15 is screwed into the threaded bore 16' for this, as is shown in FIG. 2. The finger 17 now engages in the longitudinal groove 18'. Instead of the clamping screw 24, a long clamping screw 24' is screwed into the threaded bore 23 of the transverse pin 22 in this position of the abutment part 10. The long clamping screw 24' bears via a nut 25 on the free end 17' of the finger 17, this nut 25 being fixed relative to the clamping screw 24'. In order to allow the THIRD HAND function to operate, the long clamping screw 24' is turned, whereby the transverse pin 22 is drawn towards the free end 17' of the finger 17. It thus spreads out the finger sections 17*a* against the sidewalls of the longitudinal groove 18', whereby the jamming between the abutment part 10 and the second slide 4 is produced. Thanks to the long clamping screw 24' the clamping device 19 can be actuated from the operating end even with the body 1 arranged vertically. The heavy workpiece is inserted as the first between the two jaws 7, 9 and clamped by first turning the screw spindle 5 in the previously described manner. Since its weight acts downwardly, the weight is supported on the central jaw 9 fixed relative to the body 1, so that the force applied downwardly by the spring arrangement 13 towards the central jaw 9 is adequate to grip the heavy workpiece long enough for a second workpiece to be inserted between the jaws 8, 9 and clamped.

If larger workpieces are to be clamped, which will not fit between the jaws 7 and 9 or 8 and 9, the central jaw 9 can be removed from the body 1 and single workpieces can then be clamped between the jaws 7, 8. However it is necessary for this that one of the two slides is fixed relative to the body 1. Fixing by means of the clamping device 19 provided on the finger 17 does not suffice, since the force of the spring arrangement 13 is adapted for temporary gripping but not for firm clamping. Accordingly a screw fixing bolt 26 is provided in the second slide 4 remote from the operating end 1'. The axis of this fixing bolt 26 runs perpendicular to the base part 1*a* of the body 1. A fixing bore 27 is provided in the base part 1*a*. With the central jaw 9 removed the fixing bolt 26 is screwed in so that its free end engages in the fixing bore. The second slide 4 and the jaw 8 connected thereto are then fixed in a predetermined position relative to the body 1. A larger workpiece can then be clamped between the two jaws 7, 8 by turning the screw spindle 5, as in a normal machine vice with two jaws.

What is claimed is:

1. A clamping device with a body having first and second slides movable therein, each slide carrying a respective jaw on an upper side for shifting in opposite directions by means of an axially movable screw spindle, a central jaw for fixing in a central region of the body, an abutment part arranged in a region of an operating end of the body and movable relative thereto, a clamping element associated therewith, a spring arrangement supported on the abutment part and acting in the direction of displacement of the first and second slides, the spring arrangement exerting a force on one of the slides in an opening direction thereof in a clamping state of the clamping element, and a retaining screw which extends through the abutment part, wherein the abutment part is disposed in a lower region of one of the slides and of the body facing away from the corresponding jaw, wherein the abutment part includes a lug which is slidable to a limited extent in an end recess of the body wherein the spring arrangement is supported at one end on the lug and at the other end in a pocket in a base part of the body, wherein the abutment part further comprises a finger which engages in a longitudinal groove provided at an underside of the one slide and carries the clamping element at its free end facing the central jaw, with said clamping element enabling jamming of the finger in the longitudinal groove.

2. The clamping device according to claim 1, wherein the finger is divided into two finger sections to form said clamping element, opening at the free end of the finger and extending over a substantial part of a finger length and running perpendicular to a bottom of the groove, wherein a transverse bore is provided in the vicinity of the free end of the finger, with its axis perpendicular to the bottom of the groove and which extends half into each of the finger sections, wherein a transverse pin is arranged in the transverse bore, and wherein a clamping screw engages in the groove and is disposed in the longitudinal direction of the finger and of the slide, the screw bearing on the abutment part or on the free end of the finger.

3. The clamping device according to claim 1, wherein the base part of the body comprises a second recess for the lug of the abutment part at an end opposite the operating end and a second pocket for the spring arrangement, so that the abutment part is selectively mountable at the opposite end, wherein a second slide is provided with a second longitudinal groove for engagement of the finger at its underside and wherein a second clamping screw is provided, which extends from the operating end up to a transverse pin in the finger of the abutment part selectively mounted at the opposite end.

4. The clamping device according to claim 1, wherein the retaining screw is arranged coaxial with the spring arrangement and is screwed into a threaded bore at the bottom of the pocket in the base part and wherein the lug abuts a head of the retaining screw.

5. The clamping device according to claim 1, wherein a fixing bolt is arranged in a second slide remote from the operating end, with its axis perpendicular to the base part of the body, and wherein a fixing bore is provided in the base part, so that the second slide is capable of being fixed in a predetermined position relative to the body, with the central jaw removed, by engagement of the fixing bolt in the fixing bore.

6. A clamping device comprising:

a body including an end recess and a base part having a pocket;

first and second slides movable in the body, said first slide having a longitudinal groove at an underside thereof;

first and second jaws carried on upper sides of said first and second slides;

an axially movable screw spindle for shifting said first and second jaws in opposite directions;

a central jaw for fixing in a central region of the body;

an abutment part disposed at a lower region of said first slide and at an operating end of said body and movable relative thereto, said abutment part including a lug slidable to a limited extent in the end recess of said body and including a finger for engagement in the longitudinal groove at the underside of said first slide, said finger including a clamping element at a free end thereof facing said central jaw;

a spring arrangement supported at one end by said lug of said abutment part and at an opposing end in the pocket of said base part, said spring arrangement acting in a direction of displacement of said slides to exert a force on said first slide in an opening direction thereof in a clamping state of said clamping element; and a retaining screw extending through said abutment part, wherein jamming of said finger in said longitudinal groove fixes said first jaw relative to said body.

7. The clamping device according to claim 6, wherein said clamping element is formed by a slot opening at the free end of said finger and dividing said finger into first and second finger sections, said slot extending along a substantial part of the length of said finger.

* * * * *